US008611792B2

(12) United States Patent
Nishimura et al.

(10) Patent No.: US 8,611,792 B2
(45) Date of Patent: Dec. 17, 2013

(54) OPENING/CLOSING DEVICE FOR UPPER UNIT CASE, AND IMAGE RECORDING APPARATUS PROVIDED WITH THE SAME

(75) Inventors: Yoichiro Nishimura, Nagoya (JP); Kumiko Kuriki, Nagoya (JP); Yukio Shiohara, Nagoya (JP); Kazuhito Ishida, Ichinomiya (JP); Masahisa Kato, Nagoya (JP); Tomohisa Higuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 238 days.

(21) Appl. No.: 13/072,725

(22) Filed: Mar. 27, 2011

(65) Prior Publication Data

US 2011/0243608 A1 Oct. 6, 2011

(30) Foreign Application Priority Data

Mar. 30, 2010 (JP) ..... 2010-079433
Jun. 30, 2010 (JP) ..... 2010-149351

(51) Int. Cl.
*G03G 15/00* (2006.01)

(52) U.S. Cl.
USPC ..... 399/125

(58) Field of Classification Search
USPC ..... 399/125; 220/815, 811, 812
See application file for complete search history.

(56) References Cited

U.S. PATENT DOCUMENTS 3,841,466 A 10/1974 Hoffman et al.
4,816,921 A 3/1989 Akiyama et al.
5,205,073 A 4/1993 Lyons, Sr.
7,804,628 B2 * 9/2010 Hashimoto et al. ..... 358/494
2006/0029424 A1 2/2006 Kawai et al.
2007/0119548 A1 * 5/2007 Anderson ..... 160/211
2008/0237252 A1 * 10/2008 Elefante ..... 220/811
2010/0040394 A1 2/2010 Iijima
2011/0240668 A1 10/2011 Nishimura et al.
2011/0241511 A1 10/2011 Nishimura et al.

FOREIGN PATENT DOCUMENTS

EP 0199454 A2 10/1986
FR 2734308 A1 11/1996
JP H01-029815 Y2 9/1989
JP H04-052783 A 2/1992
JP H05-019543 A 1/1993
JP H05-333610 A 12/1993
JP H06-167841 A 6/1994

(Continued)

OTHER PUBLICATIONS

Japan Patent Office, Decision to Grant a Patent for Japanese Patent Application No. 2010-080663 (counterpart to above-captioned patent application), mailed Apr. 25, 2012.

(Continued)

*Primary Examiner* — Walter L Lindsay, Jr.
*Assistant Examiner* — Rodney Bonnette
(74) *Attorney, Agent, or Firm* — Baker Botts L.L.P.

(57) ABSTRACT

There is provided an opening/closing device for an upper unit case, including a pair of guide members formed of lower and upper guide members provided on lower and upper unit cases respectively, at least one of the lower and upper guide member being configured to be swingable in an up and down direction; a movable body which is connected movably to the lower and upper guide members and which has a rotary body installed in the movable body while being fitted rollably with respect to the lower and lower guide members; and a regulating mechanism which regulates swinging amount in the up and down direction of the at least one guide member configured to be swingable in the up and down direction.

11 Claims, 5 Drawing Sheets

(56) References Cited

FOREIGN PATENT DOCUMENTS

| | | | |
|---|---|---|---|
| JP | H08-054810 | A | 2/1996 |
| JP | H11-038714 | A | 2/1999 |
| JP | 2000-159251 | A | 6/2000 |
| JP | 2005-297278 | A | 10/2005 |
| JP | 2006-044061 | A | 2/2006 |
| JP | 2007-336451 | A | 12/2007 |
| JP | 2010-045736 | A | 2/2010 |

OTHER PUBLICATIONS

European Patent Office, extended European Search Report for European Patent Application No. 11159633.4 (counterpart European patent application), dated Feb. 11, 2013.

European Patent Office, extended European Search Report for European Patent Application No. 11159634.2 (counterpart European patent application), dated Feb. 8, 2013.

State Intellectual Property Office of the People'S Republic of China, Notification of First Office Action for Chinse Patent Application No. 201110083718.8 (counterpart to above-captioned patent application), mailed on May 31, 2013.

United States Patent and Trademark Office, Non Final Rejection for U.S. Appl. No. 13/072,739 (related to above-captioned patent application), mail Jun. 13, 2013.

United States Patent and Trademark Office, Non Final Rejection for U.S. Appl. No. 13/072,721 (related to above-captioned patent application), mailed Jun. 13, 2013.

* cited by examiner

OPENING/CLOSING DEVICE FOR UPPER UNIT CASE, AND IMAGE RECORDING APPARATUS PROVIDED WITH THE SAME

CROSS REFERENCE TO RELATED APPLICATION

The present application claims priority from Japanese Patent Applications No. 2010-079433 filed on Mar. 30, 2010 and No. 2010-149351 filed on Jun. 30, 2010, the disclosure of which are incorporated herein by reference in their entirety.

BACKGROUND OF THE INVENTION

1. Field of the Invention

The present invention relates to an opening/closing device for an upper unit case which is installed to be rotatable in an opening/closing direction with respect to a lower unit case. More specifically, the present invention relates to construction of an opening/closing device, for an upper unit case, in which the upper unit case is configured to be movable slowly in a closing direction thereof, and an image recording apparatus provided with the opening/closing device for the upper unit case.

2. Description of the Related Art

Conventionally, in an image recording apparatus such as a printer, a facsimile machine, a copying machine, etc., a paper feeding section (sheet feeding section), a recording section, etc. are provided on a lower unit case. On the other hand, a manuscript (original) reading section is provided on an upper unit case. A hinge is provided on the upper case at one side thereof, and the upper unit case is installed to the lower unit case so that the upper unit case is rotatable via the hinge in the opening/closing direction. There are proposed various kinds of construction for regulating the rotating movement of the upper unit case in a closing-movement finishing zone of the rotation of the upper unit case in a case that the upper unit case is once widely opened during maintenance and/or addressing paper jam situation, etc. and then the upper unit case is to be closed.

For example, Japanese Patent Application Laid-open No. 11-38714 (FIGS. 1 and 2) discloses an opening/closing device in which an upper unit case and a lower unit case are connected by a gas spring, and a coil spring is arranged on the lower surface of the upper unit case at an free end side so that the coil spring is oriented downwardly. An end of the coil spring is supported at a receiving section in the lower unit case, in the closing-movement finishing zone, thereby preventing the upper unit case from being closed abruptly.

On the other hand, Japanese Publication of Registered Utility Model Application No. 01-29815 (FIGS. 3 and 6) discloses an opening/closing device in which an arc-shaped guide member (guide member) is formed on a side surface of an upper unit case (cover) so as to project downward, and an arc-shaped guide groove is formed in the guide member. Here, a bolt shaft is disposed at one side of a lower unit case (casing). By inserting the bolt shaft into the guide groove and by pinching (sandwiching) the guide member by the head of this bolt and a spring member, it is possible to position and hold the upper unit case at any rotational angle. Further, Japanese Publication of Registered Utility Model Application No. 01-29815 discloses a technique in which, when the upper unit case is at a position at which the upper unit case is closed (stopped and closed) with respect to the lower unit case, the upper unit case is urged upwardly by a torsion spring provided on the lower unit case.

In the above-described closing/opening devices, however, the number of parts or components are large, and a part or component having a large size such as the gas spring is required. It is also considered to provide a linear-shaped oil dumper, instead of the gas spring, or to add a rotary oil dumper to the hinge section so as to make the velocity be slow when the upper unit case is closed with respect to the lower unit case. By doing so, however, there is generated a problem such that the construction of the opening/closing device becomes more complex and/or the ratio of the opening/closing device to the entire product such as the lower unit case become greater, which in turn causes the product size to become greater.

An object of the present teaching is to simply and to make small the parts or components constructing the opening/closing device, and further to make the closing operation or movement of the upper unit case to be light and quick. Another object of the present teaching is to provide an image recording apparatus which is provided with the opening/closing device.

SUMMARY OF THE INVENTION

According to a first aspect of the present teaching, there is provided an opening/closing device which opens and closes an upper unit case with respect to a lower unit case, the opening/closing device including:

a hinge section which is provided with respect to end portions of the upper and lower unit cases and which supports the upper unit case rotatably in up and down direction with respect to the lower unit case;

a pair of guide members including a lower guide member and a upper guide member, the lower guide member being provided on the lower unit case to extend from a side of the hinge section toward a side of a free end opposite to the hinge section, the upper guide member being provided on the upper unit case to extend from a side of the hinge section to a side of a free end opposite to the hinge section, at least one guide member of the pair of guide members being configured to be swingable in the up and down direction with a portion thereof on the side of the free end as a swinging center, and one of the pair of guide members being formed to warp convexly and the other of the pair of guide members being formed to have a linear shape;

a movable body which is connected movably to the upper and lower guide members and which has a rotary body installed in the movable body and fitted rollably with respect to the upper and lower guide members, the movable body being configured so that while the upper unit case is being opened with respect to the lower unit case, the movable body moves along the upper and lower guide members from the side of the free end to the side of the hinge section, and that while the upper unit case is being closed with respect to the lower unit case, the movable body moves along the upper and lower guide members from the side of the hinge section to the side of the free end; and a regulating mechanism which regulates swinging amount in the up and down direction, at the side of the hinge section, of the at least one guide member configured to be swingable in the up and down direction.

According to the opening/closing device of the first aspect, when the load (stress) is applied in the closing direction of the upper unit case, the rotary body installed in the movable body rolls (rotates, moves) while being fitted with respect to the upper and lower guide members, and the movable body moves in a direction away from the hinge section. At this time, since the moving velocity of the movable body is not increased, it is possible to close the upper unit case slowly (gradually). On the other hand, at least one guide member of the upper and lower guide members is constructed to be swingable or rotatable in the in the up and down direction, with the portion thereof on the side of the free end as the swinging center (rotation center). When the upper case unit is opened, component of force at a contact point, at which the rotary body and the upper and lower guide members are brought into contact, for moving the movable body in a direction approaching toward the hinge section with the rotary body rolling while being fitted to the upper and lower guide members is greater than component of force in a case that the upper and lower guide members are fixed with respect to the unit cases. Therefore, it is possible to open the upper unit case lightly and quickly. Further, the construction for opening the upper unit case lightly and quickly is realized only by forming one of the upper and lower guide members to have the convexly warped shape (to warp convexly) and the other of the upper and lower guide members to have the linear shape, and by providing the movable body which is connected to the upper and lower guide members to be movable along both of the upper and lower guide members. Accordingly, it is possible to make the construction of the opening/closing device be simple and compact.

According to a second aspect of the present teaching, there is provided an image recording apparatus which performs recording of an image with respect to a medium, the image recording apparatus including:

a lower unit case;

a recording section which is disposed in the lower unit case and which performs the recording of the image with respect to the medium;

a supplying section which is disposed in the lower unit case, in which the medium is placed, and which supplies the medium to the recording section;

an upper unit case which is arranged at a position over the lower unit case; and the opening/closing device for the upper unit case of the first aspect which supports the upper unit case to be openable/closable with respect to the lower unit case.

BRIEF DESCRIPTION OF THE DRAWINGS

FIGS. 6A and 6B show a second embodiment in which the lower guide member is formed to have an upward convexly warped shape and the upper guide member is formed to have a linear shape; wherein FIG. 6A is a schematic side view showing a state of the upper and lower unit cases during an operation for opening the upper unit case with respect to the lower unit case of the second embodiment, and FIG. 6B is a schematic side view showing a state that the upper unit case is completely closed.

DESCRIPTION OF THE PREFERRED EMBODIMENTS

Figure 1B:
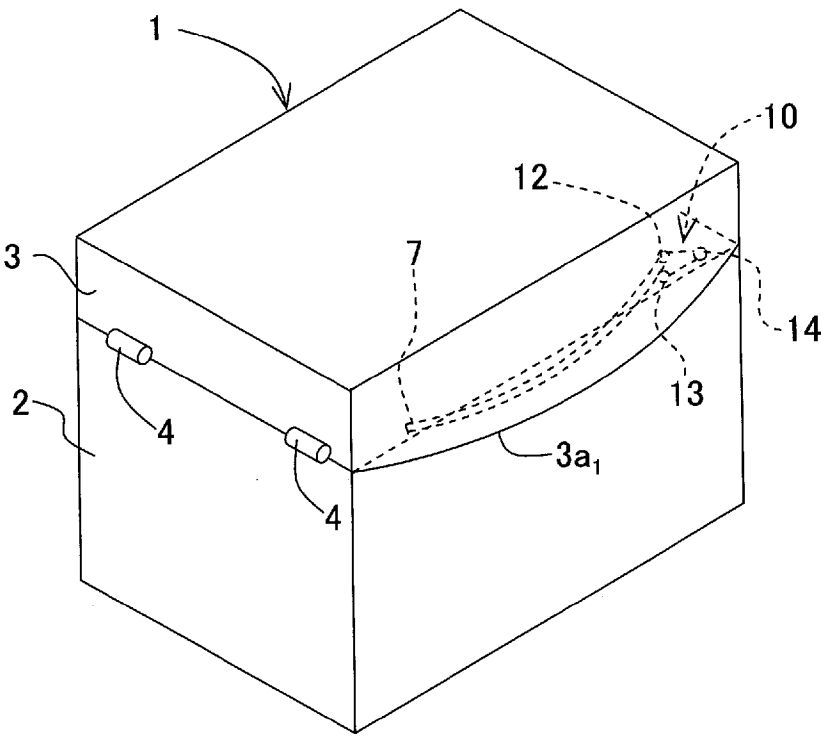
FIG. 1B is a perspective view showing a state that the upper unit case is closed.
Figure 1A:
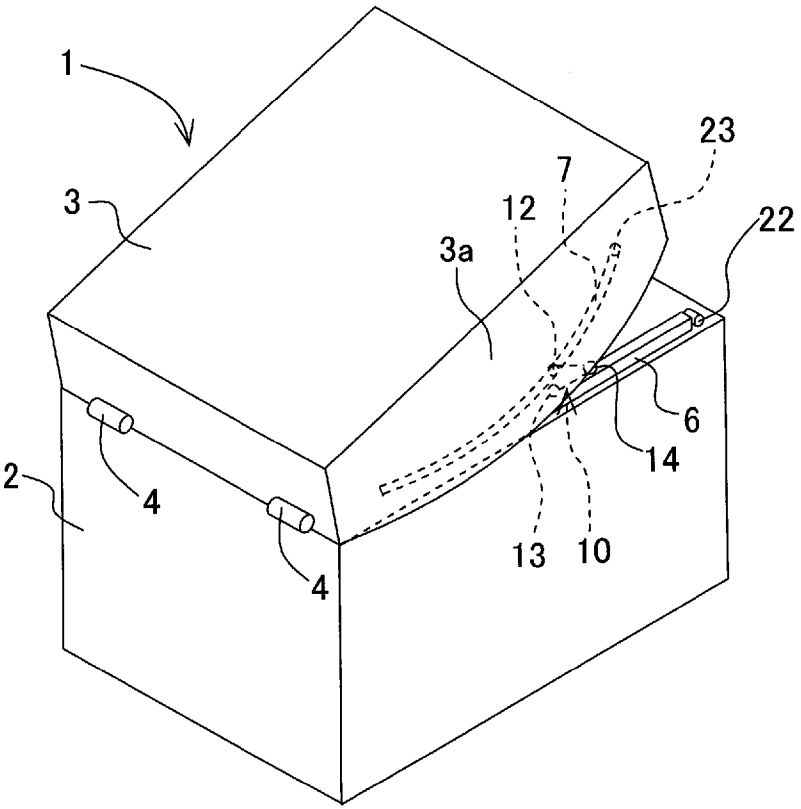
FIG. 1A is a perspective view showing a state that an upper unit case is being opened with respect to a lower unit case of a first embodiment.

A first embodiment of the present teaching will be explained with reference to FIGS. 1 to 4.

An image recording apparatus 1 of the first embodiment is an apparatus in which the present teaching is applied to a Multi Function Device (MDF) provided with printing, copying, scanning and facsimile functions. As shown in FIGS. 1 and 2, the image forming apparatus 1 is provided with a lower unit case 2 made of a synthetic resin, a hinge section 4 provided on one side of the lower unit case 2, and an upper unit case 3 which is connected to the lower unit case 2, via the hinge section 4, to be rotatable in the up and down direction.

Although not shown, a sheet-feeding cassette (paper-feeding cassette), and a recording section of the ink-jet system, etc. which is arranged at a position over or above the paper feeding cassette are arranged inside the lower unit case 2. A sheet or paper (recording medium) fed from the sheet-feeding cassette is transported to the recording section via a transporting route body which has a U-turn shape and which is arranged in installable/removable manner at the rear side of the lower unit case 2. The sheet for which the printing has been performed is discharged from an opening which is opened at a side surface of the lower unit case 2 at a position above or over the sheet-feeding cassette. The sheet-feeding cassette is also arranged to be insertable from the opening.

The upper unit case 3 is provided with a manuscript auto-feeding device and an image reading device used for realizing the copying and facsimile functions; a manuscript placement glass plate and a manuscript cover body for covering the upper surface of the manuscript placement glass plate; and an operation panel section having a various kinds of operation buttons, a liquid crystal display section, etc. (all of those above-mentioned are not shown in the drawings).

Next, an explanation will be given about an opening/closing device of the present teaching which opens and closes the upper unit case 3 with respect to the lower unit case 2. The lower unit case 2 and the upper unit case 3 are provided with a lower guide member 6 and upper guide member 7, respectively, each extending from a side of the hinge section 4 (hinge section 4-side) to a side of the free end portion (free end portion-side), the free end portion being a side opposite to the hinge section 4. Further, a movable body 10 is arranged to be movable along (with respect to) the lower guide member 6 and the upper guide member 7. The movable body 10 includes a first rotary body 12 (one rotary body of the present teaching) which is movable (rollable) along the upper guide member 7; second and third movable bodies 13, 14 (two rotary bodies of the present teaching) which are movable along the lower guide member 6; and a frame 11 which has a triangular shape as seen from side view and in which the first, second and third rotary bodies 12, 13, 14 are rollably (rotatably) installed. It is not necessarily indispensable that the frame 11 has the triangular shape, and the frame 11 may have any shape. Each of the first to third rotary bodies 12, 13, 14 is formed to have a roller shape.

In the first embodiment, the first rotary body 12 is arranged on the side of a front surface of the frame 11, having the triangular shape as seen from the side view, at the apex portion of the triangular shape; and the second and third rotary bodies 13 and 14 are arranged on the side of a back surface of the frame 11 at both angle portions (bottom portions) of the triangular shape, respectively.

As the user is opening the upper unit case 3 with respect to the lower unit case 2, the movable body 10 moves along the upper guide member 7 and the lower guide member 6 in a direction approaching to the hinge section 4-side from the open end portion-side. On the other hand, as the user is closing the upper unit case 3 with respect to the lower unit case 2, the movable body 10 moves along the upper guide member 7 and the lower guide member 6 in a direction approaching to the open end portion-side from the hinge section 4-side.

In the first embodiment, the lower guide member 6 is formed to extend from the hinge section 4-side toward the free end portion-side to have substantially horizontal (flat) and linear shape. On the other side, the upper guide member 7 is formed to extend from the hinge section 4-side toward the free end portion-side while having a downward convexly-warped shape (see FIGS. 1A, 1B, 2A and 2B). Note that the term "formed to have a horizontal shape" in the present teaching is meant that the lower guide member or the upper guide member is arranged horizontally (flatly) in a state that the upper unit case 3 is completely closed with respect to the lower unit case 2.

Figure 2A:
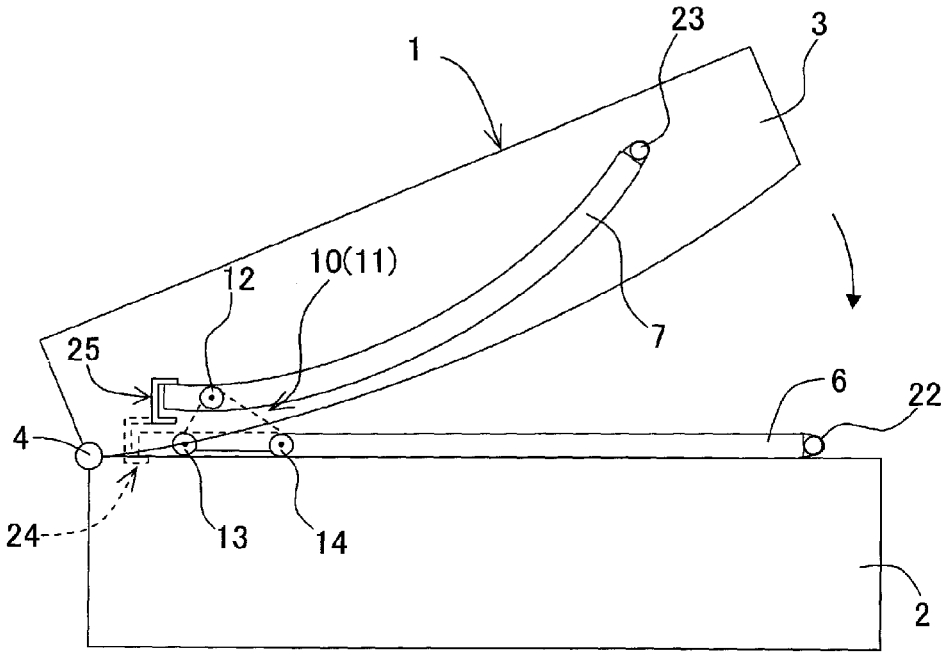
FIG. 2A is a schematic side view showing a state during an operation for closing the upper unit case with respect to the lower unit case of the first embodiment.
Figure 2B:
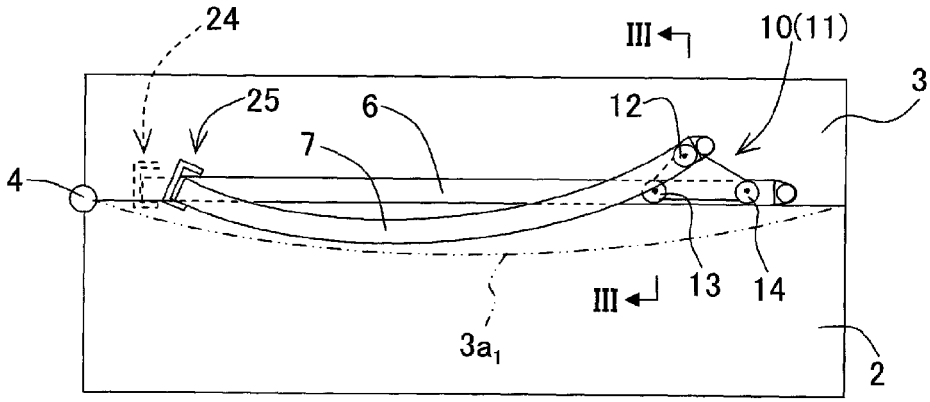
FIG. 2B is a schematic side view showing a state that the upper unit case is completely closed.

In the present teaching, at least one of the upper guide member 7 and the lower guide member 6 is constructed to be swingable or rotatable in the up and down direction, with the free end portion-side thereof as the swinging center (rotation center). The opening/closing device of the present teaching is provided the regulating mechanism which regulates the moving amount, at the side of the hinge section 4, of the guide member(s) swingable in the up and down direction. In the first embodiment, as shown in FIGS. 2A and 2B, the lower guide member 6 is constructed to be swingable in the up and down direction with respect to the lower unit case 2, with a rotation axis 22 arranged at the free end portion-side as the swinging center. The upper guide member 7 is constructed to be swingable in the up and down direction with respect to the upper unit case 3, with a rotation axis 23 arranged at the free end portion-side as the swinging center.

Figure 5A:
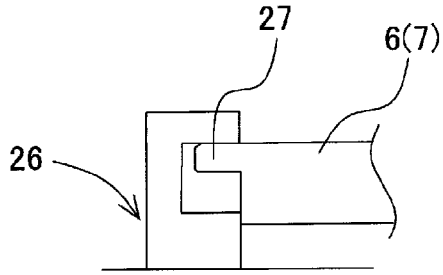
FIG. 5A shows a second embodiment of a regulating mechanism.
Figure 5B:
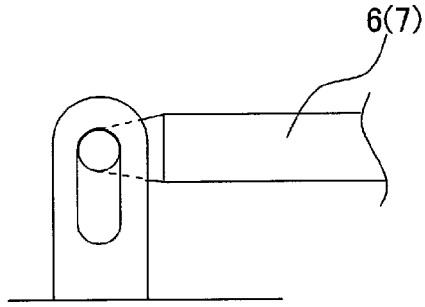
FIG. 5B shows a third embodiment of the regulating mechanism.

Regulating mechanisms 25, 24 which regulate movement amounts, of the upper guide member 7 and the lower guide member 6, in the up and down direction at the hinge section 4-side are provided on the upper unit case 3 and the lower unit case 2, respectively. In the first embodiment, each of the regulating mechanisms 24, 25 has a frame member having a horizontal U-shape as seen in side view and including an upper end piece, a lower end piece and a connecting piece which connects the upper and lower end pieces; and an end portion of each of the lower and upper guide members 6, 7 is fitted between the upper and lower end pieces so that the end portion of each of the lower and upper guide members 6, 7 is movable in the up and down direction. In a second embodiment (to be described later on) of the regulating mechanism, as shown in FIG. 5A, the regulating mechanism has a construction including a frame member 26 having a horizontal U-shape as seen in side view and provided on the upper unit case 3 or the lower unit case 2, in a similar manner as the regulating mechanism in the first embodiment. A projection piece 27, projected from an end portion of the upper guide member 7 or the lower guide member 6, is fitted between the upper end piece and the lower end piece of the frame member 26 so that the projection piece 27 is movable in the up and down direction only by a predetermined amount. In a third embodiment (to be described later on) of the regulating mechanism, as shown in FIG. 5B, the regulating mechanism has a construction including a bracket 28 provided on the upper case unit 3 or the lower case unit 2, and a guide groove 29 which is formed in the bracket 28 and is elongated in the up and down direction. A guide pin 30 which is formed at an end portion of the upper guide member 7 or the lower guide member 6 is fitted to the guide groove 29 such that the guide pin 30 is movable in the up and down direction only by a predetermined amount. Note that in each of the embodiments, it is allowable to make at least one of the lower and upper guide members 6 and 7 to be swingable, and to make the regulating mechanism correspond to the at least one swingable regulating mechanism among the lower and upper guide members 6 and 7.

The lower guide member 6 and the upper guide member 7 are both made to have a U-shaped cross section, and are configured so that the first, second and third rotary bodies 12, 13 and 14 are rollable (rotatable) along inside of rail grooves 15, 16 formed in the lower guide member 6 and the upper guide member 7, respectively. The lower guide member 6 is arranged on a upper surface 2*a* (or a side surface) of the lower unit case 2, and the groove 15 is arranged to be open toward an outer side surface of the lower unit case 2; the upper guide member 7 is arranged on an inner surface of a side surface plate 3*a* of the upper unit case 3 so that the groove 16 is opened toward the inside of the upper unit case 3 (see FIG. 3). When the upper unit case 3 is opened/closed with respect to the lower unit case 2, the side surface plate 3*a* and the upper guide member 7 are located to be outside of a side surface plate 2*b* of the lower unit case 2 so as to prevent an intermediate portion of the upper guide member 7, formed to warp convexly downward, from interfering with the lower unit case 2 (see FIG. 3). In this situation, a portion of a lower end edge 3*a*1 of the side surface plate 3*a* is overlapped, in a side view, with the side surface plate 2*b* of the lower unit case 2 (see a state illustrated by solid lines in FIG. 1A and a state illustrated by two-dot-chain lines in FIG. 2B).

Figure 3:
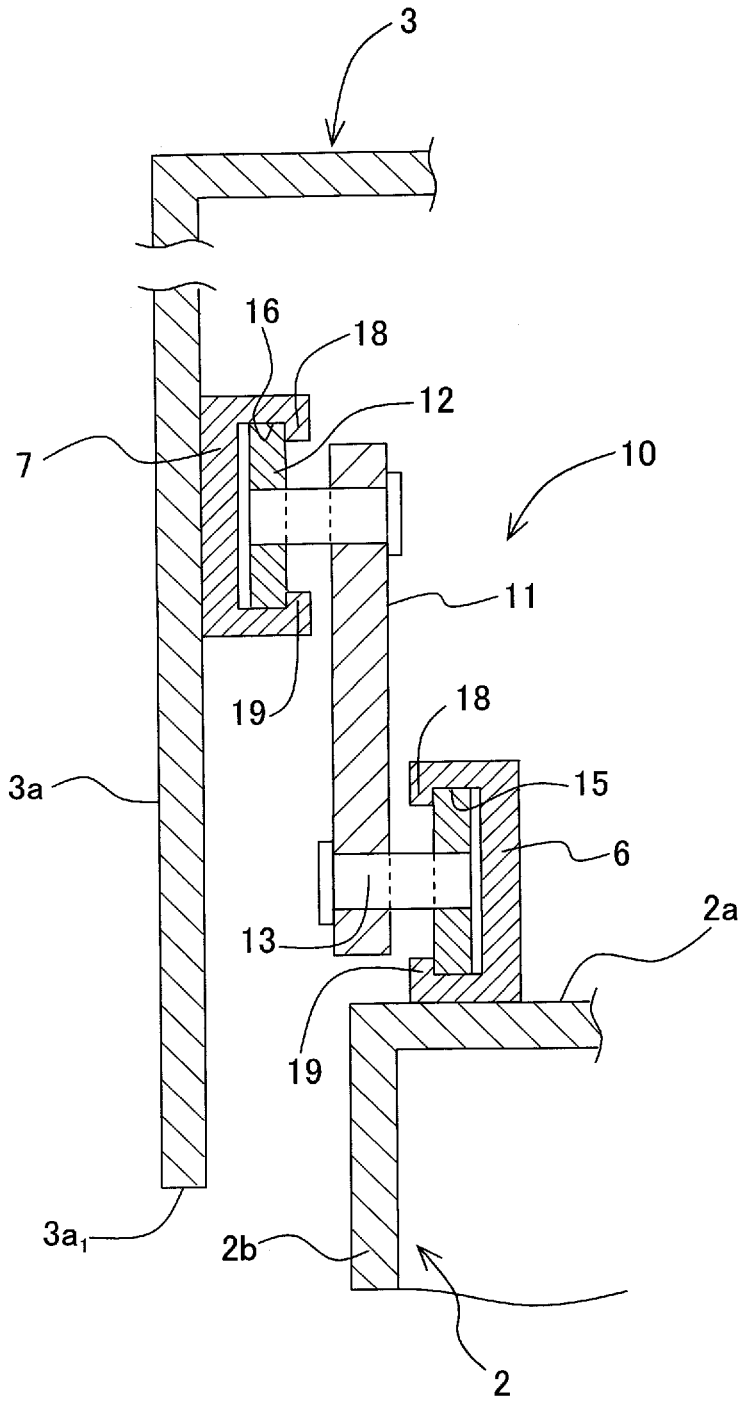
FIG. 3 is an enlarged cross-sectional view as seen from line of FIG. 2B.
Figure 4:
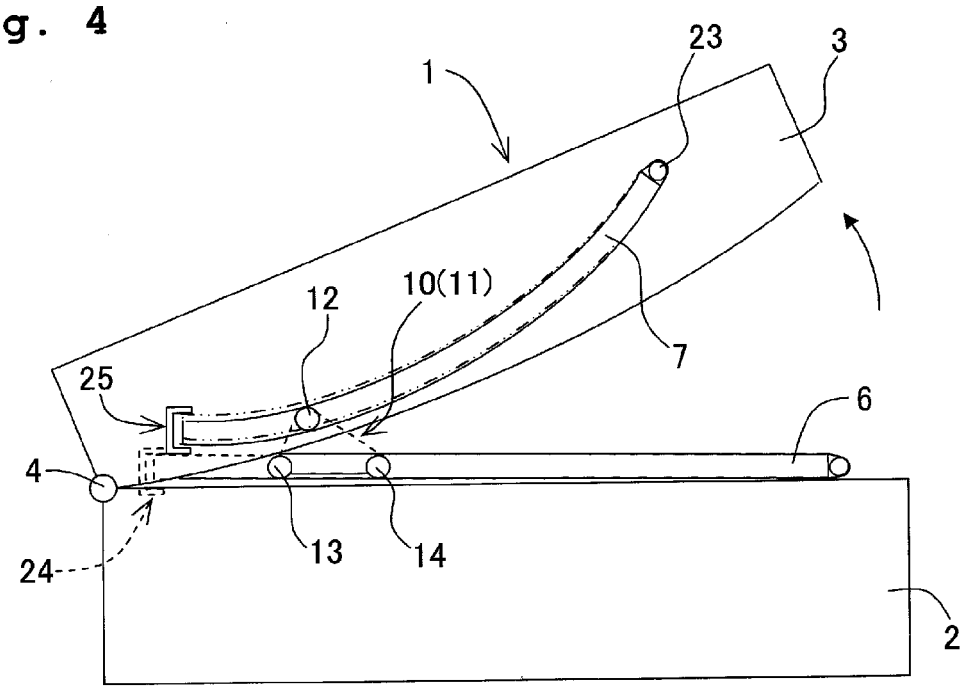
FIG. 4 is a schematic side view of a state of the upper and lower unit cases during an operation for opening the upper case unit with respect to the lower case unit of the first embodiment.

A guard piece 18 projecting from above a portion, of the upper guide member 7, defining the rail groove 16 and a guard piece 19 projecting from below the portion defining the rail groove 16 are integrally formed with the portion defining the rail groove 16 so as to surround an outer circumference portion of the first rotary body 12 (see FIG. 3). With this, there is no fear that the first rotary body 12 might be detached or fallen from the rail groove 16 of the upper guide member 7 in a direction in which the axial line of the first rotary body 12 extends. Similarly, guard pieces 18, 19 are integrally formed with a portion, of the lower guide member 6, defining the rail groove 15 so as to surround outer circumference portions of the second and third rotary bodies 13 and 14. With this, there is no fear that the second and third rotary bodies 13 and 14 might be detached or fallen from the rail groove 15 of the lower guide member 6 in a direction in which the axial lines of the second and third rotary body 13, 14 extend.

In the present teaching, when the upper unit case 3 is to be opened with respect to the lower unit case 2, the user applies upward force to the free end, etc. of the upper unit case 3. Here, it is assumed that the upper guide member 7 were fixed to the upper unit case 3 and the lower guide member 6 were fixed to the lower unit case 2. In this assumption, when the upper unit case 3 is opened fast and with great force, there is a fear that the rolling (rotational) movement of the first rotary body 12 with respect to the rail groove 16 of the upper guide member 7 might be delayed and the rolling movements of the second and third rotary bodies 13, 14 with respect to the rail groove 15 of the lower guide member 6 might be delayed. As a result, forces pulling upward/downward act on the contact point of the first rotary body 12 with respect to the upper guide member 7 and on the contact points of the second and third rotary bodies 13, 14 with respect to the lower guide member 6, respectively. In such a case, the component of force for moving the movable body 10 toward the hinge section 4 becomes small; and thus the movable body 10 cannot move lightly and quickly toward the hinge section 4.

Whereas in the embodiment, both of the upper guide member 7 and the lower guide member 6 are configured to be swingable in the up and down direction with respect to the unit cases, with portions thereof on the far side from (opposite side of) the hinge section 4 (free end portion-side) as the rotation center. Further, the moving amounts in the up and down direction of the upper guide member 7 and the lower guide member 6 are respectively regulated to be an appropriate amount (about 2 to 5 mm), by the regulating mechanisms 25, 24, which are arranged at a side close to the hinge section 4. Therefore, the component of force for moving the movable body 10 toward the hinge section 4 is greater than that in a case wherein both the upper and lower guide members 7 and 6 are fixed to the unit cases. Accordingly, it is possible to open the upper unit case 3 lightly and quickly. When the user stops applying the upward force with respect to the free end, etc. of the upper unit case 3, then the movable body 10 is stopped at a position at which the user stopped the application of force, thereby making it possible to maintain the opening angle of the upper unit case 3.

Figure 6A:
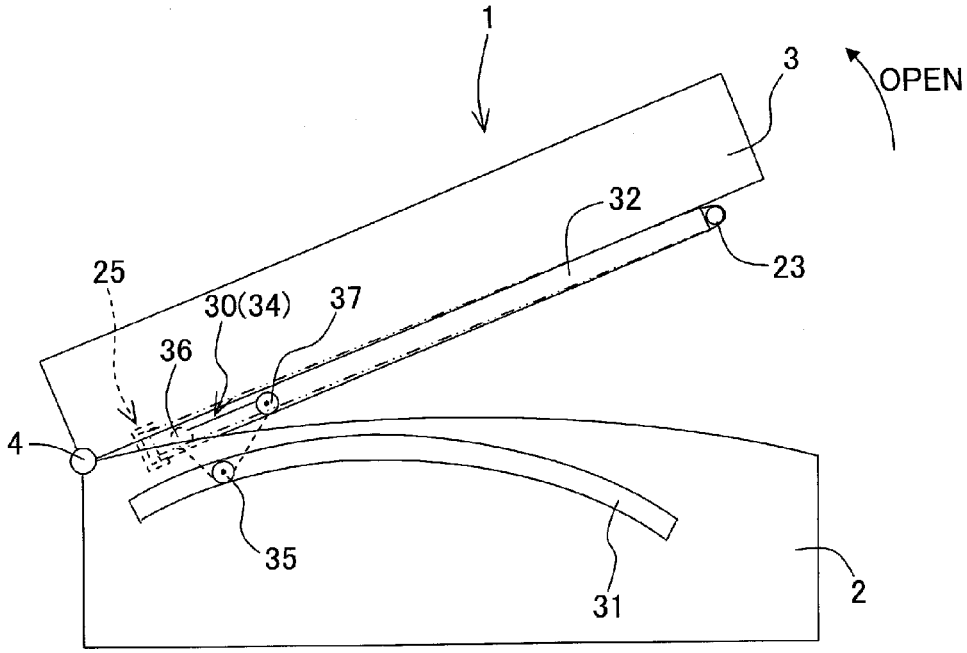
Figure 6B:
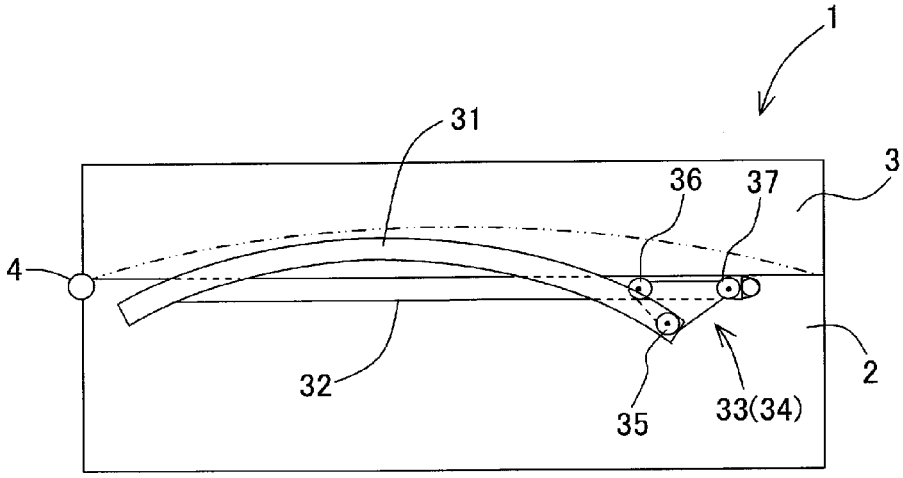

In a second embodiment as shown in FIGS. 6A and 6B, a lower guide member 31 warping convexly upward is arranged on the lower unit case 2 so that the lower guide member 31 extends from the hinge section 4-side toward the free end portion-side; and a upper guide member 32 is arranged on the upper unit case 3 so that the upper guide member 32, having a linear and level shape in a state that the upper unit case 3 is closed, extends from the hinge section 4-side toward the free end portion-side. Further, there is provided a movable body 33 having a downward triangular shaped frame 34. A first rotary body 35 is installed rollably (rotatably) in the frame 34 at a lower end portion thereof; and second and third rotary bodies 36, 37 are installed rollably to upper end portions of the frame 34. As an operation by the user for opening the upper unit case 3 with respect to the lower unit case 2 is being progressed, the movable body 33 moves along the upper and lower guide members 32 and 31 in a direction approaching to the hinge section 4-side from the open end portion-side. On the other hand, as an operation by the user for closing the upper unit case 3 with respect to the lower unit case 2 is being progressed, the movable body 33 moves along the upper and lower guide members 32 and 31 in a direction approaching to the open end portion-side from the hinge section 4-side.

Although the lower guide member 31 is fixed with respect to the lower unit case 2, the upper guide member 32 is constructed to be swingable in the up and down direction with respect to the upper case unit 3, at a portion thereof on the free end portion-side, with a rotation axis 32 as the swinging center. Further, a regulating mechanism 25 is provided to regulate the moving amount in the up and down direction at the hinge section 4-side in the upper guide member 32. As the regulating mechanism, it is possible to adopt various mechanisms, as described above.

Also in the second embodiment, when the upper unit case 3 is closed, the first rotary body 35 rolls while making contact with the lower surface of the guide groove in the lower guide member 31, and the second and third rotary bodies 36, 37 roll while making contact with the upper surface of the guide groove in the upper guide member 32. The constructions of the first to third rotary bodies 35 to 37 and the constructions of the upper and lower guide members 32 and 31 are same as those in the first embodiment. In a state that the upper case unit 3 is closed with respect to the lower unit case 2, the lower guide member and the upper guide member are partially overlapped in a height direction of the unit cases, as seen in the extending direction of the upper and lower guide members. Further, since the constructions of the movable body 10, etc. are same as those in the first embodiment, any detailed explanation therefor will be omitted.

Also in the second embodiment, the upper guide member 32 is constructed to be swingable in the up and down direction with a far side thereof from the hinge section 4 (free end portion-side) as the swinging center. Further, the moving amount in the up and down direction of the upper guide member 32 at a side close to the hinge section 4 is regulated by the regulating mechanism 25 to be an appropriate amount (about 2 to 5 mm). Accordingly, the component of force for moving the movable body 10 toward the hinge section 4 is greater than that in a case wherein the upper and lower guide members are fixed with respect to the unit cases, thereby making it possible to open the upper unit case 3 lightly and quickly. When the user stops the application of upward force with respect to the free end, etc. of the upper unit case 3, then the movable body 10 is stopped at a position at which the user stopped the application of force, thereby making it possible to maintain the opening angle of the upper unit case 3. Note that in the present teaching, it is allowable that one of or both of the upper and lower guide members 32 and 31 is/are constructed to be swingable in the up and down direction with the free end portion thereof as the swinging center, and that the regulating mechanism is provided regulating the moving amount in the up and down direction at the hinge section 4-side of one or both of the guide member(s) which is/are swingable in the up and down direction. This also makes it possible to achieve the operational effect same as in the first embodiment.

It is allowable to adopt in the present teaching various embodiments or modifications within a scope without deviating from the gist or essential characteristics of the present teaching. Namely, when the upper guide member or the lower guide member has a linear shape, the upper unit case needs not to have a flat shape when the upper unit case is closed, and it is allowable that the upper unit case has an inclined or oblique shape upward or downward toward the free end portion-side when the upper unit case is closed. Further, the upper and lower unit cases are applicable to body and lid sections of electronic products and furniture, etc., in addition to the application to the image recording apparatuses.

What is claimed is:

1. An opening/closing device which opens and closes an upper unit case with respect to a lower unit case, the opening/closing device comprising:

a hinge section which is provided with respect to end portions of the upper and lower unit cases and which supports the upper unit case rotatably in up and down direction with respect to the lower unit case;

a pair of guide members including a lower guide member and a upper guide member, the lower guide member being provided on the lower unit case to extend from a side of the hinge section toward a side of a free end opposite to the hinge section, the upper guide member being provided on the upper unit case to extend from a side of the hinge section to a side of a free end opposite to the hinge section, at least one guide member of the pair of guide members being configured to be swingable in the up and down direction with a portion thereof on the side of the free end as a swinging center, and one of the pair of guide members being formed to warp convexly and the other of the pair of guide members being formed to have a linear shape;

a movable body which is connected movably to the upper and lower guide members and which has a rotary body installed in the movable body and fitted rollably with respect to the upper and lower guide members, the movable body being configured so that while the upper unit case is being opened with respect to the lower unit case, the movable body moves along the upper and lower guide members from the side of the free end to the side of the hinge section, and that while the upper unit case is being closed with respect to the lower unit case, the movable body moves along the upper and lower guide members from the side of the hinge section to the side of the free end; and a regulating mechanism which regulates swinging amount in the up and down direction, at the side of the hinge section, of the at least one guide member configured to be swingable in the up and down direction.

2. The opening/closing device for the upper unit case according to claim 1, wherein the lower guide member is formed to have the linear shape, and the upper guide member is formed to have a downward convexly warped shape; and the rotary body of the movable body includes three rotary bodies one of which is arranged to be movable along the upper guide member and two of which are arranged to be movable along the lower guide member.

3. The opening/closing device for the upper unit case according to claim 2, wherein the movable body is constructed so that three axes of the three rotary bodies are arranged at apexes of a triangle; and the one of the three rotary bodies is configured so that a force received thereby at a contact point with the upper guide member is directed to be between the two of the three rotary bodies.

4. The opening/closing device for the upper unit case according to claim 2, wherein guard pieces are formed in the upper and lower guide members, respectively, the guard pieces preventing the three rotary bodies from being detached from the upper and lower guide members in a direction of axes of the three rotary bodies.

5. The opening/closing device for the upper unit case according to claim 4, wherein a rail groove extending in a length direction of each of the upper and lower guide members is formed in each of the upper and lower guide members so that each of the upper and lower guide members has a U-shaped cross section defined by the rail groove; and each of the guard pieces is formed integrally with a portion, of one of the upper and lower guide members, defining the rail groove so as to narrow an opening of the rail groove.

6. The opening/closing device for the upper unit case according to claim 2, wherein the upper guide member and the lower guide member are partially overlapped, as seen from a direction in which the upper and lower guide members extend, in height directions of the upper and lower unit cases in a state that the upper and lower unit cases are closed.

7. The opening/closing device for the upper unit case according to claim 1, wherein the upper guide member is formed to have the linear shape, and the lower guide member is formed to have an upward convexly warped shape; and the rotary body of the movable body includes three rotary bodies one of which is arranged to be movable along the lower guide member and two of which are arranged to be movable along the upper guide member.

8. The opening/closing device for the upper unit case according to claim 7, wherein guard pieces are formed in the upper and lower guide members, respectively, the guard pieces preventing the three rotary bodies from being detached from the upper and lower guide members in a direction of axes of the three rotary bodies.

9. The opening/closing device for the upper unit case according to claim 8, wherein a rail groove extending in a length direction of each of the upper and lower guide members is formed in each of the upper and lower guide members so that each of the upper and lower guide members has a U-shaped cross section defined by the rail groove; and each of the guard pieces is formed integrally with a portion, of one of the upper and lower guide members, defining the rail groove so as to narrow an opening of the rail groove.

10. The opening/closing device for the upper unit case according to claim 7, wherein the upper guide member and the lower guide member are partially overlapped, as seen from a direction in which the upper and lower guide members extend, in height directions of the upper and lower unit cases in a state that the upper and lower unit cases are closed.

11. An image recording apparatus which performs recording of an image with respect to a medium, the image recording apparatus comprising:

a lower unit case;

a recording section which is disposed in the lower unit case and which performs the recording of the image with respect to the medium;

a supplying section which is disposed in the lower unit case, in which the medium is placed, and which supplies the medium to the recording section;

an upper unit case which is arranged at a position over the lower unit case; and the opening/closing device for the upper unit case as defined in claim 1 which supports the upper unit case to be openable/closable with respect to the lower unit case.

* * * * *